United States Patent [19]

Francis

[11] Patent Number: 4,877,247

[45] Date of Patent: Oct. 31, 1989

[54] BACKGAMMON SCORE TOWER

[76] Inventor: Raymond L. Francis, P.O. Box 1015, Youngstown, Fla. 32466

[21] Appl. No.: 544,989

[22] Filed: Oct. 24, 1983

[51] Int. Cl.[4] ..... A63F 9/00; A63F 9/04; A63F 3/02

[52] U.S. Cl. ..... 273/148 R; 273/248; 273/145 B; 273/DIG. 26

[58] Field of Search ..... 273/145 B, 148 R, 148 A, 273/285, 248, DIG. 26, 287, 260, 261

[56] References Cited

U.S. PATENT DOCUMENTS

| | | | |
|---|---|---|---|
| 239,997 | 4/1881 | Widger | 273/148 A |
| 439,450 | 10/1890 | Ward | 273/148 A |
| 710,993 | 10/1902 | Norrington | 273/148 A |
| 834,301 | 10/1906 | Hollis | 273/148 R |
| 1,685,723 | 9/1928 | Robins | 273/287 X |
| 2,450,325 | 9/1948 | Zirin | 273/285 X |
| 3,170,696 | 2/1965 | Nielsen | 273/287 X |
| 3,613,261 | 10/1971 | Petty | 273/287 X |
| 3,768,812 | 10/1973 | Basa | 273/145 B X |
| 3,951,412 | 4/1976 | Adams | 273/145 B X |

FOREIGN PATENT DOCUMENTS

| | | | |
|---|---|---|---|
| 349357 | 3/1905 | France | 273/248 |

OTHER PUBLICATIONS

Spalding & Bros. Catalog 1903–1904 p. 87, #82, Oak Chip Rack.

Sears 1979 Christmas Book p. 360 10–1979 (3) Suedette Backgammon Set #3C2876.

The Washington Post, 6/11/75 p. B10, Backgammon International Sets (273/287).

*Primary Examiner*—Paul E. Shapiro

[57] ABSTRACT

A structure for the backgammon board that combines means to; record cumulative and games-won scores, retain and display the doubling cube precisely, hold a dice-casting device, and retain, display and facilitate dispersement of stones.

12 Claims, 1 Drawing Sheet

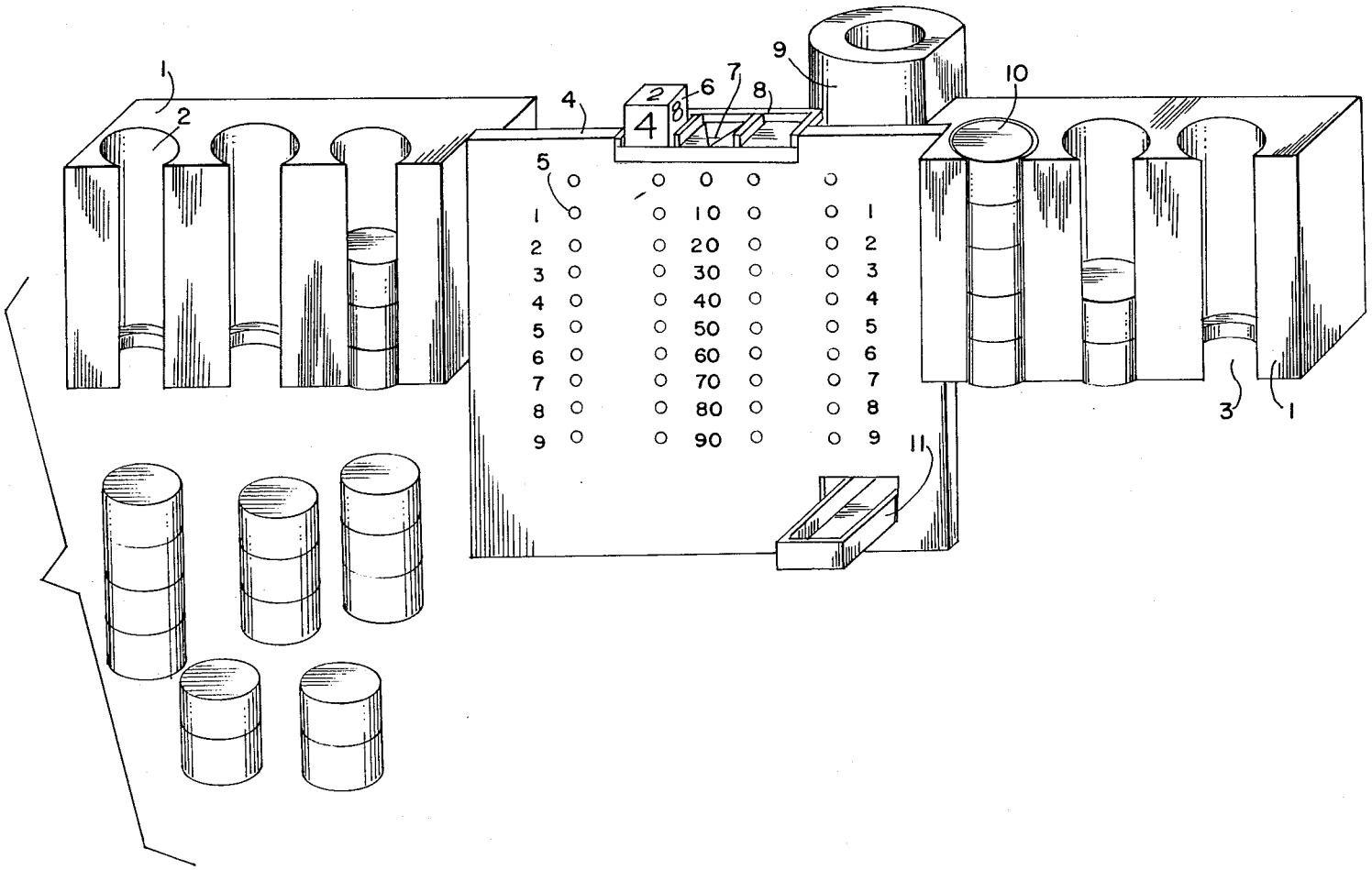
1
2
3
4
5
6
7
8
9
10
11
0 10 20 30 40 50 60 70 80 90
1 2 3 4 5 6 7 8 9

BACKGAMMON SCORE TOWER

CROSS-REFERENCE TO A RELATED APPLICATION

A patent appliction is in preparation on improvements to the design of the backgammon board itself.

ACKNOWLEDGEMENTS

The inventor wishes to thank his parents and Inventors Workshop International of Ventura, Calif. for invaluable aid in this project.

BRIEF SUMMARY

The present invention, an article of manufcture, is an addition to the standard backgammon board. It contains scoring means to record both games won and points accumulated, means of precisely holding and displaying the doubling cube, means of retaining a dice-casting device and means to organize, display and facilitate dispersement of stones.

BRIEF DESCRIPTION OF DRAWING

The drawing is an oblique projection of the Score Tower, in a game in which the current score is seven to three, as clearly indicated by the stones retained.

BACKGROUND

Backgammon probably pre-dates chess by "thousands of years", and had endured much unchanged until approximately 1925, when the doubling cube was introduced, adding a unique element of skill to the game. The survival of the game can possibly be explained by its effective balance of luck and skill, the sociality it encourages and its simplicity.

The present invention is aimed at facilitating the ease of play, structuring and displaying the off-board pieces, encouraging the use of the doubling cube, thereby enhancing appreciation of the game, facilitating learning by highlighting the fundamental elements of play and score, and providing a structure to which a dice-casting device (which ensures fairness of dice roll) can be applied. Other benefits will undoubtedly be discovered.

DESCRIPTION AND PREFERRED EMBODIMENT OF THE INVENTION

Referring to the FIGURE, the Score Tower comprises a horizontal member 4, attached to which is a subdivided platform 8, a dice-casting device 9, and two slotted blocks 1.

Said horizontal member is endowed with a plurality of numbered holes 5, which serve to hold pegs. A peg in a particular hole indicates that that player has won that number of points. This is referred to as a peg-and-hole scoring system. Other, known scoring means can be used also, such as the sliding marker system, which consists of a numbered member over which a marker is drawn as the score is increased. Another system is the window-and-wheel system, in which numbers appearin a window in the scoreboard. Electronic options in score-keeping are seemingly endless.

Although not drawn, the Score Tower can accomodate two scoring systems, one to record the cumulative score over a number of games (drawn), and the other to record the total number of games won (not drawn). Although the former statistic is the more valid indicator of performance, the latter is interesting and commonly recorded. The type of scoring system built into the Score Tower is unimportant to the uniqueness of the present invention; its combination with other functional units is.

As pictured, platform 8 is affixed to the top of member 4; the platform is subdivided into three sections. The doubling cube 6 positioned nearer to one player indicates his ownership of the cube; center positioning indicates neutrality; a cube sitting on an oblique angle in the center subdivision indicates a value of one. The center subdivision contains a triangular ablation 7 to permit oblique resting of the doubling cube.

The dice-casting device 9 here is modelled after the "Game Board" device of G. Utter (U.S. Pat. No. 1,569,688), but there are a handful of other, equally suitable, old devices. The preferred embodiment is a readily-detachable, but strongly-held, device. Member 11 is the exit trough for dice.

Blocks 1 are stone holders. They serve to: (a) organize and protect out-of-play stones 10; (b) display the score of the in-progress game clearly, which facilitates decision-making via instant, exact recognition of the game's progress; (c) facilitate setting-up the next game by breaking a player's stones into groups of five; two of the four starting positions require five stones each; (d) dispense the stones in a cluster that is easy to manually manipulate; the ablated section 3 of the bottom horizontal member accomodates any digit on a hand. The means of attachment of 1 to 4 irrelevant; it could be permament, as in gluing or single-piece construction, or temporary, to allow stones to be transported and used away from the backgammon board.

Similarly, the means of attachment of the Score Tower to the backgammon board itself is of minor importance. The preferred embodiment is to have the Score Tower hingedly connected to a border member of the board and foldable within the board when the game is not in use.

The sub-units described above function aesthetically and strategically as a single unit when attached as a whole to one end of the backgammon board. Firstly, the Score Tower gives the playing field an appearance of an arena. Secondly, the entire history of an afternoon's play is revealed at a glimpse, which enhances the enjoyment of both player and spectator.

What is claimed is:

1. A score tower for use with a backgammon game board having a doubling cube and stones comprising:

(a) a body;

(b) thirty stones;

(c) means for keeping score;

(d) means in said body for holding said doubling cube; and (e) means for retaining said stones in groups of five comprising six recesses in said body, each recess having an edge slot, a bottom shoulder, and a finger groove extending into said shoulder beneath the recess, each recess having a depth equal to the thickness of five stones.

2. The device of claim 1, wherein said means for holding said doubling cube comprises surfacing on which said doubling cube rests.

3. The device of claim 2, wherein said means for holding said doubling cube comprises three aligned platforms formed in an upper surface of said device.

4. The device of claim 3, wherein the centermost of said three aligned platforms has aan ablation which permits said doubling cube to rest obliquely thereon.

5. An accessory for use with a backgammon game board having a doubling cube and stones, said device comprising:

a score tower, said score tower incorporating:

(a) means for keeping score;

(b) means for holding a doubling cube comprising three aligned platforms formed in an upper surface of said tower, the centermost platform having an ablation which permits a doubling cube to ret obliquely thereon;

(c) means for retaining said stones comprising means forming six stone retaining recesses, each recess having an edge slot and bottom shoulder, and a finger groove extending into the shoulder beneath the recess.

6. The apparatus of claim 5, further comprising thirty stones, each stone having a thickness wherein said recesses in said stone holder are each five thicknesses deep.

7. An accessory device for use with a backgammon game board having a doubling cube and two groups of stones, fifteen stones in a group, said device comprising:

a score tower, said score tower incorporating:

(a) means for holding each group of stones;

(b) means for keeping score, said means for keeping score separating the means for holding one group of stones from the means for holding the other group of stones.

8. The device of claim 7, wherein said score tower incorporates means to retain each said group of fifteen stones in three sub-groups of five stones each.

9. The device of claim 8, wherein said means of retaining a sub-group of five stones comprises a recess which has a depth equal to the thickness of five stones and which has an edge slot and bottom shoulder, with a finger groove extending into the shoulder beneath the recess.

10. The device of claim 9, further comprising means to hold said doubling cube.

11. The device of claim 10, wherein the means for holding said doubling cube comprises three compartments.

12. The device of claim 11, wherein the means for holding said doubling cube comprises three aligned platforms formed in an upper surface of said tower, the centermost platform having an ablation which permits a doubling cube to rest obliquely thereon.

* * * * *